United States Patent [19]

Shim et al.

[11] 4,419,251

[45] Dec. 6, 1983

[54] AQUEOUS LUBRICANT

[75] Inventors: Joosup Shim, Wenonah; Derek A. Law, Pitman, both of N.J.

[73] Assignee: Mobil Oil Corporation, New York, N.Y.

[21] Appl. No.: 419,107

[22] Filed: Sep. 16, 1982

[51] Int. Cl.[3] ..... C10M 1/24; C10M 1/36; C10M 1/48; C10M 1/40

[52] U.S. Cl. ..... 252/32.7 E; 252/33.3; 252/34.7; 252/40.7; 252/42.1; 252/51.5 A; 252/49.5

[58] Field of Search ..... 252/32.7 E, 40.5, 42.1, 252/40.7, 33.3, 51.5 A, 49.5, 54.7

[56] References Cited

U.S. PATENT DOCUMENTS 3,378,494 4/1968 Berger ..... 252/49.5

3,939,088 2/1976 Goldschmidt et al. ..... 252/49.5

4,225,447 9/1980 Law et al. ..... 252/49.5

*Primary Examiner*—Jacqueline V. Howard

*Attorney, Agent, or Firm*—Alexander J. McKillop; Michael G. Gilman; Charles J. Speciale

[57] ABSTRACT

A lubricant concentrate is provided for forming stable, translucent oil-in-water emulsions upon dilution with a major part of water. The concentrate comprises a suitable base oil with a combination emulsifier/dispersant system and antiwear/antirust inhibitor system. Typical emulsifier/dispersants include the metal soaps of rosin acids, the alkylene oxide condensation products of a fatty amine or the reaction product thereof with a polyalkenylsuccinic acid or anhydride. Zinc dialkyldithiophosphates and metal dialkylnaphthalene sulfonates are useful antiwear and antirust inhibitors.

15 Claims, No Drawings

AQUEOUS LUBRICANT

BACKGROUND OF THE INVENTION

1. Field of the Invention

This invention relates to water-content hydraulic fluids and more particularly a concentrate for addition to water for the preparation of water-content hydraulic fluids. The invention further relates to a method of lubricating with water-content hydraulic fluids which may contain up to 95% or more water.

2. Description of the Prior Art

Heretofore, the technology of lubrication generally centered about the development of petroleum oils for lubricants or greases and the application of the lubricant so prepared to the point of wear or friction. Innumerable and complex lubricating compositions have been proposed comprising, generally, a hydrocarbon oil, a bodying or thickening ingredient and various additive agents designed to enhance the lubricant with respect to viscosity, foam stability, antiwear, and corrosion prevention properties. More recently, current interest has been directed to the preparation of aqueous lubricants, particularly water-content hydraulic fluids, due to the increasing cost of petroleum oils, the problem of flammability and the ever increasing problem of suitable disposal of contaminated or spent petroleum-based fluids. Water-content hydraulic fluids containing up to 95 percent or more water offer an obvious cost advantage over petroleum-based hydraulic fluids but suffer the disadvantage of having poor lubricating characteristics, thereby markedly reducing the service life of hydraulic pumps ordinarily used in industrial equipment. Although primarily used for transmitting forces, water-content hydraulic fluids necessarily must provide lubrication for impellers, support bearings, rings, gears, pistons, and other mechanical parts, in order to prevent excessive wear and fatigue failure of such parts.

It is known from U.S. Pat. No. 4,215,002 to prepare water-content hydraulic fluids by adding to water 0.5 to 4 wt.% of a blend of $C_{6-18}$ alkylphosphonate or an amine adduct thereof and an ethoxylate of an acid or an alcohol containing from 3 to 20 ethoxy groups wherein the acid or alcohol is derived from fatty or synthetic sources.

U.S. Pat. No. 4,225,447 discloses an emulsifiable concentrate for use in water-in-oil fire-resistant hydraulic fluids comprising a lubricant and an alkenylsuccinic anhydride or a salt thereof.

U.S. Pat. No. 4,253,975 discloses an aqueous hydraulic fluid containing a metal dithiophosphate and a system of solubilizers therefor.

It is also known from U.S. Pat. No. 4,289,636 to provide aqueous lubricating compositions comprising water and a minor amount of a water-soluble amide derived from primary and secondary alkyl amines and succinic, tetrahydrophthalic or tetrahydrofuran tetracarboxylic acids. The amide is effective as a corrosion or antirust inhibitor. Aqueous lubricant formulations containing the amide in combination with other known special purpose additives provide a blend having good hard water stability characteristics.

SUMMARY OF THE INVENTION

According to the present invention, an emulsifier/dispersant system is combined with an antiwear/antirust inhibitor system, and the combined systems, when added to an appropriate base oil, provide an improved soluble oil concentrate capable of forming stable, translucent oil-in-water emulsions with water in which the oil is present as the continuous phase. The concentrates of the invention comprise a blend of suitable paraffinic, naphthenic or synthetic base oils with an emulsifier/dispersant system and antiwear/antirust inhibitor system. Neither the emulsifier/dispersant system or antiwear and antirust inhibitor system alone is soluble and dispersible in water. It was found, however, that when both systems are combined with an appropriate base oil and mixed with a sufficient quantity of water, the resulting oil-in-water emulsions are excellent lubricants characterized by improved wear preventing characteristics and antirust performance. When utilized as high water-content hydraulic fluids, significant improvement in bearing fatigue life is obtained which thus makes it possible to prolong or extend the pump life of hydraulic pumps conventionally used in industrial applications.

DETAILED DESCRIPTION OF THE INVENTION

The oil soluble concentrate used in accordance with the invention will contain from about 25 to 60 percent by weight of the emulsifier/dispersant system and about 10 to 20 percent by weight of the antiwear/antirust inhibitor system. The balance of the concentrate comprises a mineral or synthetic base oil and, possibly, minor amounts of other additives conventionally employed to impart certain properties. Among such additives are defoamers, metal deactivators, antibacterial agents, and the like. In practicing the invention, the concentrate is simply diluted with distilled or deionized water to provide hydraulic fluids consisting of about 80 to 99 weight percent water and 0.005 to 10.0 percent concentrate. On the basis of results obtained, significant improvement in bearing fatigue life is achieved when the amount of the concentrate is less than 5.0% based on the weight of the hydraulic fluid composition.

EMULSIFIER/DISPERSANT SYSTEM

The emulsifier/dispersant systems used for purposes of the invention include a wide variety of anionic, cationic and nonionic compounds which are well known in the art and have been employed for this purpose. Any compatible combination of emulsifying or dispersing agent can be employed. Likewise, compounds which possess both emulsifying and dispersing properties may be employed alone or in combination with other emulsifiers and/or dispersants. The emulsifier/dispersant systems serve to disperse the antirust and antiwear additives in the aqueous phase of the water-content fluids and hence various combinations are thus possible for this purpose.

Typical anionic emulsifiers suitable for the present invention are amine soaps, and the like. Such soaps are prepared by the reaction of an amine with a fatty acid such as palmitic acid, lauric acid, oleic acid, myristic acid, tall oil acids, palm oil acids, or the like, in about stoichiometric amounts at room temperature or slightly elevated temperatures. Examples of amine soaps include triethanolamine stearate, triethanolamine oleate, triethanolamine coconut oil soap, isopropanolamine oleate, N,N-oleate, and the like.

The cationic emulsifiers contemplated herein are the combination of an organic acid, such as acetic acid or the like, with an amine such as cyclic imidazoline, tertiary ethoxylated soya amine, tallow polyethoxylated amine having two ethoxy units in the polyethoxylated position of the molecule, oleyl polyethoxylated amines having two to five ethoxy units in the polyethoxylated portion of the molecule, soya polyethoxylated amine having five ethoxy units in the polyethoxylated portion of the molecule, and the like.

Other emulsifiers include the alkali and alkaline earth metal salts of fatty acids, rosin acids and naphthenic acids. Preferred fatty acids are the wood, gum and rosin acids derived from crude tall oil and various distilled products of tall oil. Tall oil is a byproduct of the sulfate industry where it is found in the sulfide liquor that has been used to digest wood. The oil is a crude product containing various unsaturated fatty acids, chiefly oleic and linoleic, rosin acids and some unsaponifiable materials. The crude tall oil can be employed as such in our invention, however, more suitably, the metal salts or soaps of various refined or distilled products of the crude oil are employed. Examples of these are the tall oil distillate that contains only slight amounts of rosin acids and from about 75–90% unsaturated fatty acids. Other products are distilled tall oil having 25–35% rosin acids and 60–75% fatty acids. The tall oil pitch from the distillation has from about 20–25% rosin acids and 30–40% unsaturated fatty acids, the balance being unsaponifiable material.

The alkali and alkaline salts of rosin acids are water insoluble and are highly useful emulsifiers for purposes of the invention. Additionally, they also aid in sealing the tolerances between the moving surfaces of hydraulic pumps.

Other emulsifiers which can be employed are non-ionic and include the polyalkylene glycol ethers containing from about 4 to about 80 moles of alkylene oxide. Illustrative non-ionic emulsifiers are the nonylphenyl polyethylene glycol ethers containing about 4 moles of ethylene oxide, the trimethylnonyl polyethylene glycol ethers containing about 6 moles ethylene oxide, the nonylphenyl polyethylene glycol ethers containing about 7 moles of ethylene oxide, mixed polyalkylene glycol ethers containing about 60 moles of a mixture of ethylene oxide and 1,2-propylene oxide in a mole ratio of about 2:1. The nonionic emulsifiers are well known in the art and may be prepared by condensing a 1,2 alkylene oxide, preferably ethylene oxide, with an organic compound containing at least 6 carbon atoms and a reactive hydrogen atom such as alcohols, phenols, thiols, primary and secondary amines and carboxylic and sulfonic acids and their amides. The amount of alkylene oxide or equivalent condensed with a reactive chain will generally depend upon the particular compound employed. About 20 and 85 percent by weight of combined alkylene oxide is generally obtained in a condensation product, however, the optimum amount of alkylene oxide or equivalent utilized will depend upon the desired hydro-phobiclipophilic balance desired.

The preferred dispersant used herein is the reaction product of amine with an alkyl or alkenyl succinic acid anhydride. Any alkyl or alkenyl succinic acid anhydride or the corresponding acid is utilizable in the present invention. The general structural formulae of these compounds are:

Anhydride Acid

-continued

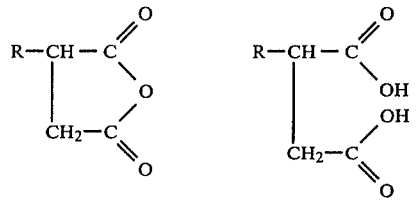

wherein R is an alkyl or alkenyl radical. When R is alkenyl, the alkenyl radical can be straight-chain or branched-chain; and it can be saturated at the point of unsaturation by the addition of a substance which adds to olefinic double bonds, such as hydrogen, sulfur, bromine, chlorine, or iodine. It is obvious, of course, that there must be at least two carbon atoms in the alkenyl radical, but there is no real upper limit to the number of carbon atoms therein. The alkyl and alkenyl succinic acid anhydrides and succinic acids are interchangeable for the purposes of the present invention.

The methods of preparing the alkenyl succinic acid anhydrides are well known to those familiar with the art. The most feasible method is by the reaction of an olefin with maleic acid anhydride.

A more detailed description of the alkenyl succinic anhydrides suitable for use in the above formulations and their preparation, is disclosed in U.S. Pat. No. 2,638,450, issued May 12, 1953.

Any alkyl or alkenyl succinic acid, the alkyl or alkenyl substituent of which contains from about 6 to about 22 carbon atoms may be employed for reaction with the amine. Typically representative of such alkyl or alkenyl succinic acids, are tetrapropenyl-succinic, octenylsuccinic, dodecenylsuccinic, polybutenylsuccinic, hexadecenylsuccinic, triacontenylsuccinic and isooctadecylsuccinic acids. Especially prepferred materials are alkenylsuccinic anhydrides wherein the alkenyl radical is derived from an olefin containing 2 to 10 carbon atoms and has an average molecular weight of from about 300 to 3000, preferably about 900 to about 1300.

The alkyl or alkenyl succinic acid anhydrides are reacted with an amine such as the aforementioned amines listed for preparation of the cationic emulsifiers. The reaction is carried out at temperatures of about 150° C. to 250° C. and the exact composition of the resulting product mixture is extremely complex depending upon whether primary amines or tertiary hydroxy amines enter into the reaction. This may be illustrated as follows:

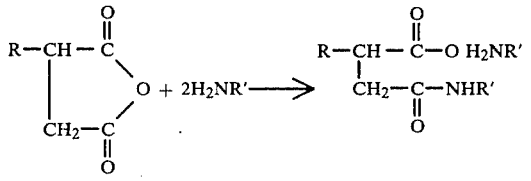

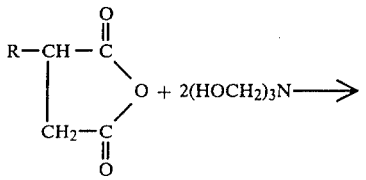

-continued

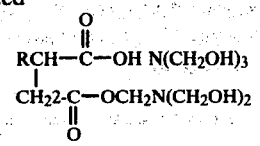

The neat concentrate will contain about 25 to 60 percent by weight of the emulsifier/dispersant system in which the emulsifier is present in an amount ranging from 20 to 50 percent by weight or more.

THE ANTIWEAR/ANTIRUST SYSTEM

The antiwear/antirust inhibitor system is present in amounts ranging from about 10 to 20 percent by weight based on the weight of the neat concentrate. It is contemplated that a wide variety of additives conventionally employed to impart antiwear and antirust properties may be used. Specifically useful antiwear inhibitors are zinc dialkyl dithiophosphates such as zinc di (isooctyl primary) dithiophosphate, zinc di (n-octyl primary) dithiophosphate, zinc butyl hexyl dithiophosphate, zinc butyl, 1,2-di methylpropyl dithiophosphate and zinc di(4 methyl-2-pentyl) dithiophosphate.

Although the zinc dialkyl dithiophosphates provide antiwear and some antirust properties, it has been found desirable to add an additional antirust inhibitor to the concentrate such as a metal dialkylnaphthalene sulfonate. The metal dialkylnaphthalene sulfonate has a sulfonate group attached to one ring of the naphthalene nucleus and an alkyl group attached to each ring. Each alkyl group can independently contain from about six to about twenty carbon atoms, but it is preferred that they contain from about eight to twelve carbon atoms. The dialkylnaphthalene sulfonate group is attached to the metal through the sulfonate group. In the case of monovalent metals, one dialkylnaphthalene sulfonate group is attached to each metal atom while there are two groups attached to each atom of a divalent metal. Calcium, barium, sodium, magnesium and lithium can be used as the metal, but it is preferred to use calcium as the metal in the sulfonate. The metal dialkylnaphthalene sulfonate is used in amounts of 30 to 60 percent by weight based on the weight of the combined antiwear/antirust inhibitor system.

The oil vehicles employed in the composition of the present invention may comprise mineral oils, synthetic oils, especially synthetic hydrocarbon oils, or combinations of mineral oils with synthetic oils of lubricating viscosity. When high temperature stability is not a requirement, mineral oils having a viscosity of at least 40 SSU at 100° F., and particularly those falling within the range from about 60 SSU to about 6,000 SSU at 100° F. may be employed. In instances where synthetic vehicles are employed, either alone or in addition to mineral oils, as the lubricating vehicle, various compounds of this type may be successfully utilized. Typical synthetic vehicles include polypropylene glycol, trimethylolpropane esters, neopentyl and pentaerythritol esters, di-(2-ethyl hexyl)sebacate, di-(2-ethyl hexyl) adipate, dibutyl phthalate, fluorocarbons, silicate esters, silanes, esters of phosphorus-containing acids, liquid ureas, ferrocene derivatives, hydrogenated mineral oils, chain-type polyphenols, siloxanes and silicones (poly-siloxanes), alkyl-substituted diphenyl ethers typified by a butylsubstituted bis-(p-phenoxy phenyl)ether, phenoxy phenyl ethers, and the like.

The synthetic hydrocarbons which may be used are of the type normally made by polymerizing monoolefins in the presence of a suitable catalyst, such as $BF_3$ or $AlCl_3$. The lower olefins may be employed for the purpose provided the degree of polymerization is sufficient. The lower olefins include, for example, ethylene, propylene, butylene and the like. Those useful in the practice of this invention preferably contain at least 30 carbon atoms. One such member is made by trimerizing decene. The synthetic hydrocarbon, or polyolefin, suitable for use in this invention may have an upper limit of about 75 carbon atoms. Such hydrocarbon fluids retain their fluidity at the lower temperatures and have enhanced resistance to flame and explosion hazards.

In combination with the aforementioned emulsifier/dispersant and antiwear/antirust systems, other additives may be employed to impart certain desired properties. An alkali metal nitrite may also be employed in the formulation in order to impart increased antirust properties to the lubricant composition. In this respect, more specific increased resistance to copper corrosion may be obtained by the use of the sodium salt of mercaptobenzothiazole. In addition, the overall performance properties of the lubricant composition may be enhanced by the addition of germicidal agents, particularly phenolic materials such as phenol, sodium salts of orthophenylphenol, chlorinated phenols, such as hexachlorophene, tetrachlorophenol and p-chloro-m-xylenol, and also boric acid or oxides of boron. In order to obtain fungus protection, improve the rust protection properties, and also to function as a load-support agent, an alkali metal hydroxide, serving to raise the pH of the system, may be employed. These may include, for example, sodium, lithium or potassium hydroxide. Furthermore, if desired, various water-soluble chelating agents may be employed to soften the water vehicle. Thus, for example, the sodium salt of diethylene triamine pentaacetic acid or salts of ethylenediamine tetraacetic acid or nitrilotriacetic acid can be used. Similarly, tackiness agents, such as polyisobutylene polymers may be added to increase the flow rate of water base fluids used in hydraulic pumps.

The alkali metal nitrite, when included in the final formulation is generally employed in an amount from about 0.1 to about 10 percent, and preferably from about 0.1 to about 5 percent, by weight. When the sodium salt of mercapto-benzothiazole is included in the formultion, this material is generally present in an amount from about 0.1 to about 6 percent, preferably from about 0.1 to about 3 percent, by weight. The germicidal agents disclosed above, when present, are generally employed in an amount from about 0.05 to about 3 percent, and preferably from about 0.05 to about 1.5 percent, by weight. The water-soluble boron additive, e.g., boric acid, when present, is generally employed in an amount from about 0.1 to about 5 percent, and preferably from about 0.1 to about 3 percent, by weight. The alkali metal hydroxide, e.g., sodium hydroxide, is employed in an amount from about 0.1 to about 1.5 percent, by weight when present. When any of the aforementioned chelating agents or tackiness agents are employed, these are generally present in an amount from about 0.1 to about 5 percent, by weight.

The following examples illustrate the best mode now contemplated for carrying out the invention.

EXAMPLE 1

A concentrate was prepared according to the following recipe:

| Ingredients | Parts by Weight |
|---|---|
| Solvent naphthenic neutral base stock (100 SUS at 100° F.) | 40.0 |
| Zinc dialkyl dithiophosphate | 10.0 |
| Calcium dinonyl naphthalene sulfonate | 5.0 |
| Potassium soap of processed rosin (1) | 20.0 |
| Polyoxyethylene soyamine | 25.0 |

(1) Dresinate 91. Manufactured by Hercules Powder Co.

EXAMPLE 2

A concentrate was prepared according to the following recipe:

| Ingredients | Parts by Weight |
|---|---|
| Solvent naphthenic neutral base stock (100 SUS at 100° F.) | 40.0 |
| Zinc dialkyl dithiophosphate | 10.0 |
| Calcium dinonyl naphthalene sulfonate | 5.0 |
| Potassium soap of processed rosin (1) | 20.0 |
| Reaction product of PBSA* and polyoxyethylene tallow amine | 35.0 |

(1) Dresinate 91. Manufactured by Hercules Powder Co.
*Polybutenylsuccinic anhydride - 1300 mol. wt.

EXAMPLE 3

Two parts by weight of a polyisobutylene polymer tackiness agent having an average molecular weight of about 2000 (Lubrizol 3174) were mixed with 98 parts by weight of the concentrate of Example 1.

EXAMPLE 4

Two parts by weight of a polyisobutylene polymer tackiness agent having an average molecular weight of about 1500 (Lubrizol 5183) were mixed with 98 parts by weight of the concentrate of Example 1.

The compositions of Examples 1 to 4 were admixed with distilled water to provide high-water-content fluids and then tested in the McGill roller bearing fatigue tester.

The McGill roller bearing fatigue test apparatus, constructed by McGill Manufacturing Co., is intended for measuring the fatigue lives of roller bearings commonly used in hydraulic gear pumps. This test is utilized widely throughout the bearing industry.

The test apparatus consists of four independent rotating shafts, each supported by four roller bearings. Lubricant is supplied from a single reservoir to the bearings by a circulating system independently feeding each set of four bearings. The test fluid is thermostatted at 120° F. by heatings in the reservoir. The bearings are operated at 1,800 rpm and loaded at 5,500 pounds each, equivalent to 320,000 psi surface stresses. Bearing failures are detected by metallic debris sensors located in the lubricant return line from each of the shaft/four bearing sets. Fatigue lives are reported as L10 lives; that is, the statistically determined lives at which 10% of the bearings will have failed. High fatigue lives are indicative of good fatigue protection.

As shown below in Table I, the concentrates of Examples 1 and 2 show unexpected results in extending the fatigue life of roller bearings commonly used in hydraulic gear pumps.

TABLE I

| | COMPARATIVE FATIGUE LIFE DATA | | | | | |
|---|---|---|---|---|---|---|
| | Example 1 | Example 2 | Example 3 | Example 4 | Example 5 | Example 6 |
| Distilled Water | 100.0 | 98.0 | 98.0 | 97.0 | 97.0 | 97.0 |
| Concentrate | | | | | | |
| Example 1 | | 2.0 | | | | 3.0 |
| Example 2 | | | | | 3.0 | |
| Example 3 | | | 2.0 | | | |
| Example 4 | | | | 3.0 | | |
| McGill Roller Bearing Fatigue Test | | | | | | |
| Relative L10 Life | 1 | 630 | 1.6 | 800 | 1860 | 1360 |

What is claimed:

1. A lubricant concentrate for forming oil-in-water emulsions upon dilution with water comprising a suitable mineral base oil having a viscosity ranging from about 60 SSU to about 6,000 SSU blended with:

(1) about 20 to 65% by weight of an emulsifier/dispersant system comprising:

(a) an alkali or alkaline earth metal soap of rosin acids, and (b) an alkylene oxide condensation product of a fatty amine or the reaction product thereof with a polyalkenylsuccinic acid or anhydride, and (2) about 10 to 20% by weight of an antiwear/antirust inhibitor system comprising:

(c) a zinc dialkyldithiophosphate, and (d) a metal dialkylnaphthalene sulfonate.

2. The concentrate of claim 1, wherein the emulsifier/dispersant system is the potassium soap of rosin acids and the reaction product of polybutenylsuccinic anhydride and polyoxyethylene tallow amine.

3. The concentrate of claim 1, wherein the emulsifier/dispersant system is the potassium soap of rosin acids and polyoxyethylene soyamine.

4. The concentrate of claim 1, wherein the antiwear-/antirust system is zinc di(n-octyl primary) dithiophosphate and calcium dinonylnaphthalene sulfonate.

5. The concentrate of claim 2 or 3, wherein the antiwear/antirust system is zinc di (n-octyl primary) dithiophosphate and calcium dinonylnaphthalene sulfonate.

6. A high water base fluid suitable for use as a hydraulic fluid comprising 80 to 99 weight percent water and 0.005 to 5 weight percent of the concentrate of claim 1.

7. A high water base fluid suitable for use as a hydraulic fluid comprising 80 to 99 weight percent water and 0.005 to 5 weight percent of the concentrate of claim 2.

8. A high water base fluid suitable for use as a hydraulic fluid comprising 80 to 99 weight percent water and 0.005 to 5 weight percent of the concentrate of claim 3.

9. A high water base fluid suitable for use as a hydraulic fluid comprising 80 to 99 weight percent water and 0.005 to 5 weight percent of the concentrate of claim 4.

10. A high water base fluid suitable for use as a hydraulic fluid comprising 80 to 99 weight percent water and 0.005 to 5 weight percent of the concentrate of claim 5.

11. In a method for lubricating hydraulic pumps having at least two metal surfaces in frictional contact with each other by applying thereto an aqueous lubricant composition, the improvement of using as the lubricant the composition of claim 6.

12. The method of claim 11 wherein the lubricant is the composition of claim 7.

13. The method of claim 11 wherein the lubricant is the composition of claim 8.

14. The method of claim 11 wherein the lubricant is the composition of claim 9.

15. The method of claim 11 wherein the lubricant is the composition of claim 10.

* * * * *